US007591156B2

(12) United States Patent
Peska et al.

(10) Patent No.: US 7,591,156 B2
(45) **Date of Patent: *Sep. 22, 2009**

(54) APPARATUS FOR WASHING OF ITEMS

(75) Inventors: Lawrence Peska, Garnerville, NY (US); David S. Fenster, Ramsey, NJ (US)

(73) Assignee: General Product International, Ltd., Monsey, NY (US)

( * ) Notice: Subject to any disclaimer, the term of this patent is extended or adjusted under 35 U.S.C. 154(b) by 413 days.

This patent is subject to a terminal disclaimer.

(21) Appl. No.: 11/299,875

(22) Filed: Dec. 12, 2005

(65) Prior Publication Data

US 2006/0086159 A1 Apr. 27, 2006

Related U.S. Application Data

(63) Continuation-in-part of application No. 10/644,303, filed on Aug. 20, 2003, now Pat. No. 6,973,808.

(60) Provisional application No. 60/404,584, filed on Aug. 20, 2002, provisional application No. 60/657,241, filed on Feb. 28, 2005.

(51) Int. Cl.
*B65D 33/01* (2006.01)

(52) U.S. Cl. ..... 68/235 R; 383/103

(58) Field of Classification Search ..... 68/213, 68/235 R; 223/84, 66; 383/66, 95, 97, 117, 383/100, 103

See application file for complete search history.

(56) References Cited

U.S. PATENT DOCUMENTS

| | | | | | |
|---|---|---|---|---|---|
| 4,974,967 | A * | 12/1990 | Tsuyoshi et al. | ..... | 383/97 |
| 5,320,429 | A * | 6/1994 | Toyosawa | ..... | 383/117 |
| 5,556,013 | A * | 9/1996 | Mayer | ..... | 223/84 |
| 5,829,083 | A * | 11/1998 | Sutton | ..... | 8/150 |
| 5,964,533 | A * | 10/1999 | Ziglar | ..... | 383/36 |
| 5,971,236 | A * | 10/1999 | DesForges et al. | ..... | 223/84 |
| 6,234,368 | B1 * | 5/2001 | DesForges et al. | ..... | 223/84 |
| 6,536,952 | B1 * | 3/2003 | Hsieh | ..... | 383/117 |
| 6,742,683 | B1 * | 6/2004 | Phan | ..... | 223/84 |

* cited by examiner

*Primary Examiner*—Joseph L Perrin
(74) *Attorney, Agent, or Firm*—David Aker

(57) ABSTRACT

An apparatus for washing at least one item, comprising a frame having a dome shape when viewed from its end, and a generally triangular or concave shape when viewed from its side; and a flow through mesh on the frame which allows washing fluid (generally water) to freely flow to and from the item being washed; the apparatus having an opening through which the at least one item to be washed can be placed into and removed from the apparatus. The frame may have an endless pocket; and a stiffener disposed within the pocket, the stiffener having a length exceeding that of the endless pocket, so that blunted ends of the stiffener overlap each other within the pocket. Pockets with strips make the side panels strong and resilient, protecting the items to be washed.

24 Claims, 1 Drawing Sheet

APPARATUS FOR WASHING OF ITEMS

CROSS REFERENCE TO RELATED APPLICATIONS

This application is a continuation-in-part of U.S. patent application Ser. No. 10/644,303 filed Aug. 20, 2003, which was published as United States Patent Application Publication US2004/0034943, and is now U.S. Pat. No. 6,973,808, which claims priority under 35 U.S.C. 119(e) from provisional application Ser. No. 60/404,584 filed on Aug. 20, 2002. This application also claims priority under 35 U.S.C. 119(e) from provisional application Ser. No. 60/657,241 filed on Feb. 28, 2005. All of these documents are incorporated by reference herein, in their entireties.

BACKGROUND OF THE INVENTION

1. Field of the Invention

The present invention relates to apparatus used for washing of items that may include personal care and delicate items. More particularly, it relates to apparatus used for washing of items which are readily damaged by washing machines, such as personal care items including prosthetic devices and delicate items such as lingerie generally, and in particular, brassieres.

2. Prior Art

Very delicate garments, such as items of lingerie, including brassieres, panties and other similar items, can be protected from damage by hand washing. However, with the demands of a busy schedule, this not is generally a viable option.

Many washing machines manufactured today have some settings that may be used for more gentle washing cycles. However, these setting may not be adequately gentle to preserve the shape of delicate fabrics and to prevent other types of damage. Further, it is often desirable to run a full load of various fabrics that need cleaning, and even if a gentle wash cycle is used, the mere presence of a full load of other items, during the various washing cycles, may cause damage to delicate items. Finally delicate and generally expensive items such as prosthetic devices, such as, for example, prosthetic brassieres, need to be carefully handled during machine washing to avoid damage Thus, there is a need for a way to protect the integrity of items during the machine washing process, which provides flexibility in the use of the washing machine in terms of size of load and selected washing cycles.

SUMMARY OF THE INVENTION

It is an object of the invention to provide a device for protecting items while being washed in a washing machine.

It is a further object of the invention to provide a device that does not interfere with the washing process.

It is a further object of the invention to provide a device that is relatively simple to manufacture and low in cost.

It is yet another object of the invention to provide a method for washing items, and in particular, a brassiere.

These objects and others are achieved in accordance with the invention by an enclosure for items including a simple frame and a flow through mesh on the frame that allows washing water to freely flow to and from the item being washed. The mesh may be configured with a generally rectangular pocket. A stiffing strip is disposed within the generally rectangular pocket.

An opening for the item or items to be washed may be closed by a zipper. A pocket may be provided for the zipper pull so that when in the closed position, the zipper pull is hidden, the zipper will remain closed, and the zipper pull will not damage fabrics outside the enclosure.

In use, the zipper is opened. An item (or a plurality of items), such as, for example, one or two brassieres, is placed in the enclosure. The zipper is pulled closed by the zipper pull, which is then positioned within the pocket. The enclosure, including its contents, is placed in the washing machine along with the remainder of the load to be washed. The contents are protected from rough mechanical handling by virtue of being within the enclosure, but are fully washed due to the flow through nature of the mesh. After washing, the contents of the enclosure are removed from the enclosure, and dried in any number of ways well known in the art.

A first aspect of the invention is directed toward an apparatus for washing at least one item, comprising a frame having a dome shape when viewed from its end, especially when filed with items to be washed, and a generally semicircular shape when viewed from its side; and a flow through mesh on the frame which allows washing fluid (generally water) to freely flow to and from the item being washed; the apparatus having an opening through which the at least one item to be washed can be placed into and removed from the apparatus. The frame may have an oval shape when view from its bottom.

In a second aspect, the invention is directed toward an apparatus for washing at least one item, comprising; a frame having an endless pocket; a stiffener disposed within the pocket, the stiffener having a flexible peripheral shape so that flexing of the stiffener provides a pumping action to assist in circulating washing fluid through the apparatus; and a flow through mesh on the frame which allows washing water to freely flow to and from the item being washed; the apparatus having an opening through which the at least one item to be washed can be placed into and removed from the apparatus. The stiffener may have a length exceeding that of the endless pocket, so that ends of the stiffener overlap each other within the endless pocket. The ends may be covered with a smooth, bulbous protective covering. Alternatively, the stiffener may be configured so that one end of the stiffer telescopes inside the other end.

The apparatus may further comprise a closing mechanism for closing the opening. The closing mechanism may be one of a Ziplock® arrangement, a fabric fastener or a zipper. If it is a zipper, a pocket for a zipper pull of the zipper may be provided, the pocket being sized, shaped and positioned so that when in the closed position, the zipper pull is hidden, the zipper will remain closed, and the zipper pull will not damage items outside the enclosure.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

The entire description of FIGS. 1-5, FIG. 6A and FIG. 6B of U.S. Pat. No. 6,973,808 should be reviewed to place the following description of FIG. 1 and FIG. 2 herein in context.

Figure 1:
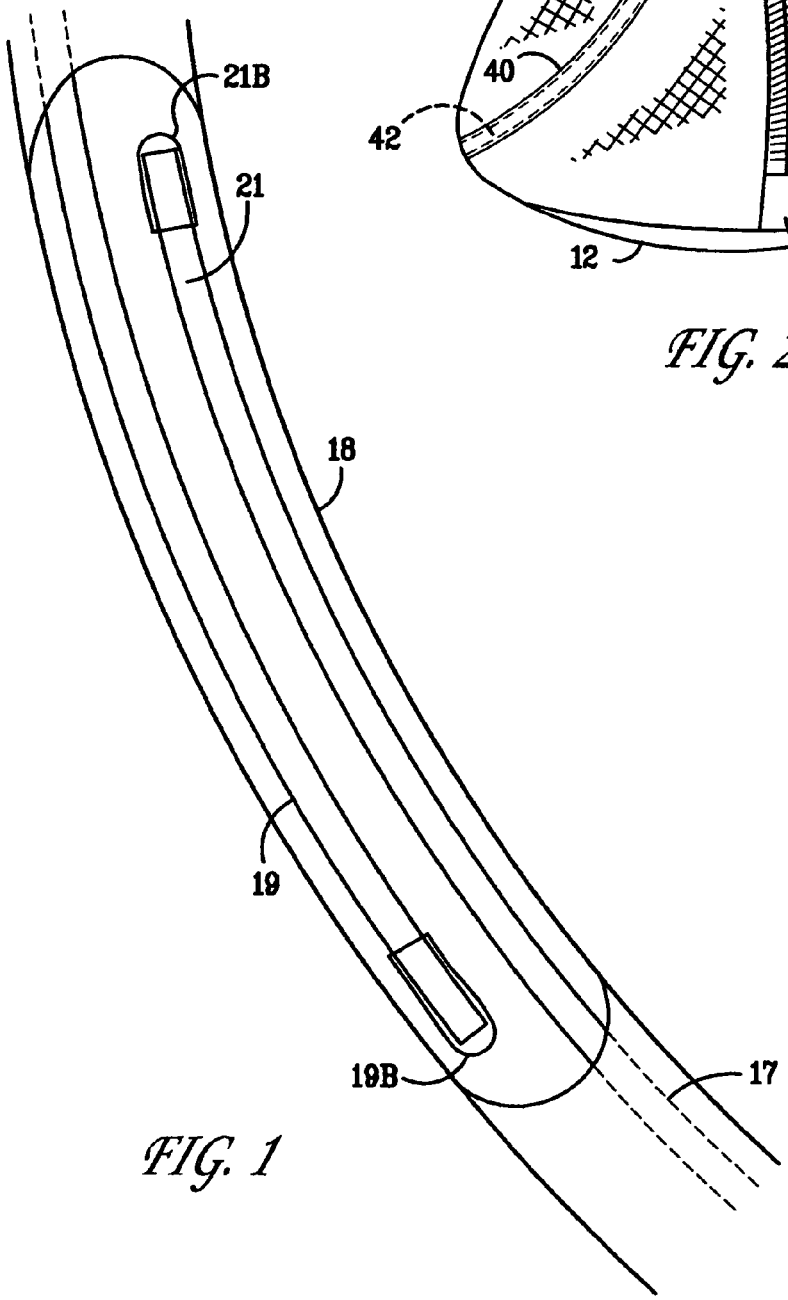
FIG. 1 is an enlarged, detailed cut-away view of an additional embodiment of a portion of FIG. 5 of U.S. Pat. No. 6,973,808.

Referring to FIG. 1, it is noted that in U.S. Pat. No. 6,973,808, it was pointed out that apparatus 10 holds its shape due to extruded plastic stiffeners formed of a material such as polypropylene, and having a diameter of approximately 1.0 millimeter. A first stiffener 17 is disposed within a first endless fabric pocket 18 sewn to bottom panel 12. The stiffener does not have to be formed as an endless loop, and may be longer than the circumference of panel 12 so that there is some overlap of its ends 19 and 21 within pocket 18. Such overlap is extremely desirable in that it provides a flexibility in the structure which prevents the stiffener from breaking due to excessive flexing during the washing process in a washing machine. Further, movement of the ends longitudinally with respect to each other so as to slightly increase and decrease the overlap, helps to provide a gentle squeezing action which is similar to that of hand washing, and serves to help circulate or pump the washing water into, through and out of apparatus 10.

The sharp ends of stiffener 17 may create a problem in that it is possible that over time they may penetrate the wall of fabric pocket 18, resulting in tearing of the structure. To solve this problem, the ends 19 and 21 of stiffener 17 are dipped into a liquid polymer material, such as a vinyl, to from protective end covers 19B and 21B, which each has a smooth, or blunted or bulbous end. Thus, the possibility of ends 19 and 21 penetrating the wall of pocket 18 is drastically reduced or entirely eliminated.

Figure 2:
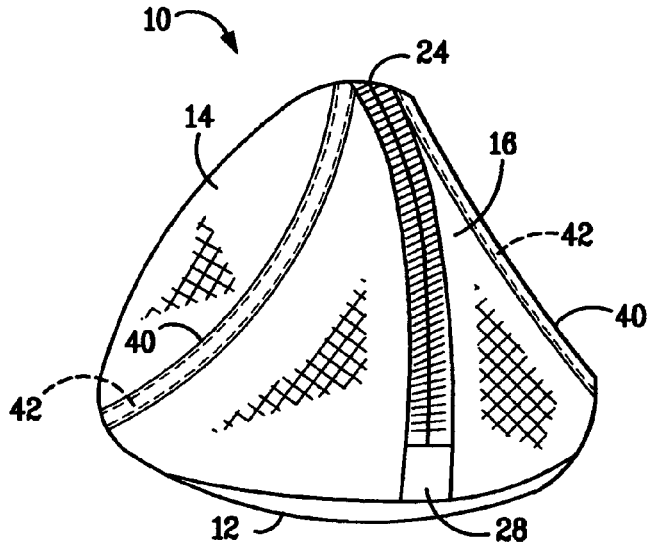
FIG. 2 is a perspective view of an alternative embodiment the apparatus illustrated in FIG. 3 of U.S. Pat. No. 6,973,808.

Referring to FIG. 2, panels 14 and 16, which are generally of semicircular shape, each have a respective pocket for receiving a respective extruded plastic stiffener. The result, due to the generally oval shape of bottom panel 12 is that the apparatus has a generally dome shape when closed and viewed from its end, and a generally semicircular shape when viewed from its side, when not temporarily deformed during washing, as discussed below. The dome shape is especially evident when the apparatus is filled with at least one item to be washed. When empty of items to be washed, the panels 14 and 16 may collapse somewhat toward one another at the top.

The dome shape is extremely advantageous in that it also serves to help circulate washing water through apparatus 10. When the apparatus is hit from almost any angle during the washing process, by other garments in a load, or by impact with parts of the washing machine in which it is placed, temporary deformations or changes in its shape also serve to assist in circulating or pumping the washing water into, through and out of apparatus 10.

A zipper 24, having a zipper pull 26, is sewn to the periphery of panels 14 and 16 where panels 14 and 16 are not connected to panel 12. Zipper 24 is configured with meshing plastic teeth, as is well known in the art. Plastic teeth are used to avoid corrosion of the teeth when they are exposed to water and detergents during the washing process, and zipper pull 26 is preferably made of a plastic material as well. An elastic pocket is provided in which the zipper pull may be concealed when apparatus 12 is closed and contains a garment to be washed. Other closing arrangements such as a Ziplock® mechanism or a Velcro® fabric fastener may also be used to releasably secure the opening.

Apparatus 10 may then be placed in a clothes washing machine, and the items or garments contained therein will be washed along with other garments in the washing machine that are not contained within apparatus 10.

In a preferred embodiment, bottom panel 12 has dimensions of approximately six inches by nine inches, as do panels 14 and 16. While apparatus 10 may be of different dimensions, these dimensions are ideal for an apparatus that receives two bras. The foamy, composite mesh protects the garments, or other items placed therein, and assists in maintaining their shape. This is particularly important for brassieres containing prosthetic inserts, as these tend to be expensive and difficult to replace.

To further protect delicate items placed within apparatus 10 for washing, each of panels 14 and 16 may be configured with a rectangular pocket 40 into which is placed a flat polymer strip 42 having some flexibility. Strip 42 may be approximately one inch wide, six inches long and 0.032 inch thick. Each pocket 40 may be formed by sewing an appropriate piece of fabric, of rectangular shape, to the inner walls of panels 14 and 16, so as to be essentially perpendicular to the plane of panel 12, and to bisect respective panels 14 and 16. Pockets 40 need be only large enough to surround and contain respective strips 42, thus not greatly decreasing the surface area of each panel 14 and 16.

The added stiffness of strips 42 serves to further protect delicate item being washed in apparatus 10, by providing an enhanced bounce to the manner in which apparatus 10 bounces off the interior components of a washing machine. However, the presence of pockets 40 with strips 42 contained therein also serves to change the contour of panels 14 and 16, having them bow inward along pockets 40, when observed from the outside. This favorably changes the angle at which apparatus 10 bounces off the interior components of the washing machine, thus providing enhanced safety for the garments contained therein, and enhanced cleaning, due to the pumping action upon the water contained within apparatus 10 provided during the enhanced bounce.

It will be understood that while the invention has been described primarily with reference to an apparatus or device for washing delicate items, and in particular items of lingerie, it may have many other uses. For example prosthetic devices of many kinds may be washed and protected, and this may be done in other environments than a washing machine. For example, these additional washing environments may include disinfecting or sterilizing apparatus. Items that can be washed within the apparatus in accordance with the invention may include hair pieces, biological waste containers that must worn on the body, and a variety of other personal care items that require periodic washing. In addition, the apparatus in accordance with the invention may be used as a container for industrial or other components or parts that may undergo a washing, disinfecting, or sterilizing process. While the washing fluid in a washing machine environment is water, it may be other fluids, such as organic solvents or cleaning fluid.

Thus, it should be understood that the foregoing description is only illustrative of the invention. Various alternatives and modifications can be devised by those skilled in the art without departing from the invention. Accordingly, the present invention is intended to embrace all such alternatives, modifications and variances.

What is claimed is:

1. An apparatus for washing at least one item, comprising;

a frame;

an endless pocket;

said frame comprising a stiffener disposed within said endless pocket, the stiffener having a length exceeding that of said endless pocket, so that ends of said stiffener overlap each other within said endless pocket, said ends being movable with respect to each other, send ends having end covers, said end covers having a smooth bulbous end; and a flow through mesh on the frame which allows washing fluid to freely flow to and from the item being washed;

said apparatus having an opening through which the at least one item to be washed can be placed into and removed from said apparatus.

2. The apparatus of claim 1, wherein the frame has an oval shape when viewed from its bottom.

3. The apparatus claim 1, further comprising a closing apparatus for closing the opening.

4. The apparatus of claim 3, wherein said closing apparatus comprises one of a zipper, a slide seal arrangement, and a fabric fastener.

5. The apparatus of claim 4, wherein said closing apparatus comprises a zipper, further comprising a pocket for a zipper pull of the zipper, the pocket being sized, shaped and positioned so that when in the closed position, the zipper pull is hidden, the zipper will remain closed, and the zipper pull will not damage items outside the enclosure.

6. The apparatus claim 1, wherein said stiffener has a flexible peripheral shape so that flexing of said stiffener provides a pumping action to assist in circulating washing fluid through said apparatus.

7. The apparatus of claim 1, configured to have a dome shape when viewed from its end, and a generally semicircular shape when viewed from its side.

8. The apparatus claim 1, wherein said mesh comprises an open weave nylon; and a polyester mesh having a continuous array of closely spaced opening.

9. The apparatus of claim 8, wherein said openings are substantially 1.0 millimeter in diameter.

10. The apparatus of claim 8, wherein said open weave nylon and said polyester mesh are nip rolled together under heat and pressure.

11. An apparatus for washing at least one item, comprising;

a frame;

an endless pocket;

said frame comprising a stiffener disposed within said endless pocket, the stiffener having a length exceeding that of said endless pocket, so that ends of said stiffener overlap each other within said endless pocket, said ends being movable with respect to each other;

a flow through mesh on the frame which allows washing fluid to freely flow to and from the item being washed, said mesh being configured with a generally rectangular pocket;

a stiffing strip disposed within said generally rectangular pocket; and said apparatus having an opening through which the at least one item to be washed can be placed into and removed from said apparatus.

12. The apparatus of claim 11, wherein the frame has an oval shape when viewed from its bottom.

13. The apparatus claim 11, further comprising a closing apparatus for closing the opening.

14. The apparatus of claim 13, wherein said closing apparatus comprises one of a zipper, a slide seal arrangement, and a fabric fastener.

15. The apparatus of claim 14, wherein said closing apparatus comprises a zipper, further comprising a pocket for a zipper pull of the zipper, the pocket being sized, shaped and positioned so that when in the closed position, the zipper pull is hidden, the zipper will remain closed, and the zipper pull will not damage items outside the enclosure.

16. The apparatus claim 11, wherein said stiffener has a flexible peripheral shape so that flexing of said stiffener provides a pumping action to assist in circulating washing fluid through said apparatus.

17. The apparatus of claim 11, configured to have a dome shape when viewed from its end, and a generally semicircular shape when viewed from its side.

18. The apparatus claim 11, wherein said mesh comprises an open weave nylon; and a polyester mesh having a continuous array of closely spaced opening.

19. The apparatus of claim 18, wherein said openings are substantially 1.0 millimeter in diameter.

20. The apparatus of claim 18, wherein said open weave nylon and said polyester mesh are nip rolled together under heat and pressure.

21. An apparatus for washing at least one item, comprising;

a frame;

an endless pocket;

said frame comprising a stiffener disposed within said endless pocket, the stiffener having a length exceeding that of said endless pocket, said stiffener being configured so that a first end of said stiffener moveably telescopes within a second end of said stiffener;

a flow through mesh on the frame which allows washing fluid to freely flow to and from the item being washed, said mesh being configured with a generally rectangular pocket;

a stiffing strip disposed within said generally rectangular pocket; and a stiffing strip disposed within said generally rectangular pocket; and said apparatus having an opening through which the at least one item to be washed can be placed into and removed from said apparatus.

22. The apparatus claim 21, wherein said stiffener has a flexible peripheral shape so that flexing of said stiffener provides a pumping action to assist in circulating washing fluid through said apparatus.

23. An apparatus for washing at least one item, comprising;

a frame;

an endless pocket on a periphery of an oval mesh panel;

said frame comprising a stiffener disposed within said endless pocket;

a flow through mesh on the frame which allows washing fluid to freely flow to and from the item being washed, said mesh having two portions configured so that said apparatus has a dome shape when viewed from its end, and a generally semicircular shape when viewed from its side, each of said portions of said mesh being configured with a generally rectangular pocket, a stiffing strip disposed within each said generally rectangular pocket so as to stiffen a respective portion, so that items in said apparatus are further protected during washing; and said apparatus having an opening through which the at least one item to be washed can be placed into and removed from said apparatus.

24. The apparatus of claim 23, wherein said stiffing strips cause said portions to bow inward when observed from the outside.

* * * * *